US007049560B2

(12) United States Patent
Fukuda et al.

(10) Patent No.: US 7,049,560 B2
(45) Date of Patent: May 23, 2006

(54) TAPE HEATER

(75) Inventors: Keiichi Fukuda, Tokyo (JP); Yoshiyuki Motoyoshi, Tokyo (JP)

(73) Assignee: Nichias Corporation, Tokyo (JP)

( * ) Notice: Subject to any disclaimer, the term of this patent is extended or adjusted under 35 U.S.C. 154(b) by 86 days.

(21) Appl. No.: 10/813,170

(22) Filed: Mar. 31, 2004

(65) Prior Publication Data

US 2004/0188419 A1 Sep. 30, 2004

(30) Foreign Application Priority Data

Mar. 31, 2003 (JP) ..... 2003-095556

(51) Int. Cl.
*H05B 3/34* (2006.01)

(52) U.S. Cl. ..... 219/549; 219/528; 392/472

(58) Field of Classification Search ..... 219/549, 219/211–213, 528–529, 545; 392/472, 480
See application file for complete search history.

(56) References Cited

U.S. PATENT DOCUMENTS 5,371,240 A * 12/1994 Slemon ..... 549/73
5,394,507 A * 2/1995 Okamoto ..... 392/480

* cited by examiner

*Primary Examiner*—Robin Evans
*Assistant Examiner*—Vinod Patel
(74) *Attorney, Agent, or Firm*—Jeffrey I. Auerbach

(57) ABSTRACT

A tape heater includes an electric heating wire disposed on a surface of a heat-resistant, flexible substrate strip. The electric heating wire and the substrate strip are wrapped with a heat-resistant resin wrap.

7 Claims, 1 Drawing Sheet

TAPE HEATER

BACKGROUND OF THE INVENTION

1. Field of the Invention

The present invention relates to tape heaters for heating or keeping warm a straight or curved pipe provided in a precision apparatus or device, capable of being wound around the pipe, and particularly to a tape heater intended for use in a clean room which hardly generates dust.

2. Description of the Related Art

For heating or keeping warm straight or curved pipes in a precision apparatus or device, for example, Japanese Unexamined Patent Application Publication No. 11-108283 has disclosed a pipe having a heater in contact along the internal surface of the pipe. For example, Japanese Unexamined Patent Application Publication No. 2002-295783 has disclosed a mantle heater having a shape corresponding to the shape of an object, namely, a straight or curved pipe, comprising an internal layer and an external layer formed of a flexible synthetic resin sheet and a heating element between the internal and external layers. Furthermore, for example, Japanese Unexamined Patent Application Publication No. 2002-228087 has disclosed a heat-insulating fiberglass tape comprising a fiberglass tape and thin thermoplastic sheets bonded on the upper and lower surfaces of the fiberglass tape by heat adhesion.

For use of the pipe with a heater of Japanese Unexamined Patent Application Publication No. 11-108283, it is necessary to select a pipe suitable for the shape of portions to be heated. For a special shape, a pipe with such a shape has to be additionally designed. Mass production is therefore difficult. Furthermore, the pipe with a heater is difficult to apply to a pipe with a small diameter.

In the mantle heater of Japanese Unexamined Patent Application Publication No. 2002-295783, whose mantle is made of a flexible synthetic resin, it is necessary to select a mantle according to the inner diameter of the pipe to be heated.

The heat-insulating fiberglass tape of Japanese Unexamined Patent Application Publication No. 2002-228087 is applicable to various shapes of pipes and heat-resistant because it comprises thin thermoplastic resin sheets bonded by heat adhesion to the upper and lower surfaces of a fiberglass tape capable of being wound. In addition, it has been designed to minimize glass fibers flying off. However, the fiberglass tape is merely for insulating heat, but not for heating to maintain a predetermined temperature.

SUMMARY OF THE INVENTION

Accordingly, an object of the present invention is to provide a tape heater for heating or keeping warm a straight or curved pipe provided in a precision apparatus or device, capable of being wound around the pipe, and particularly a tape heater intended for use in a clean room which hardly generates dust.

According to an aspect of the present invention, a tape heater is provided which includes a heat-resistant, flexible substrate strip, a heating element disposed on the strip, and a wrap comprising a heat-resistant resin sheet, wrapping the substrate strip and the heating element.

The heating element may be a heating wire whose periphery is covered with a heat-resistant, insulative layer.

The tape heater may further include a heat-conductive material between the heating element and the wrap.

The tape heater may further include a heat-insulating layer between the wrap and the surface opposite the surface having the heating element of the substrate strip.

The tape heater of the present invention can be used for heating or keeping warm a straight or curved pipe in precision apparatuses and devices. Since the tape heater hardly generates dust, it can be suitably used in a clean room or the like.

DESCRIPTION OF THE PREFERRED EMBODIMENTS

Figure 1:
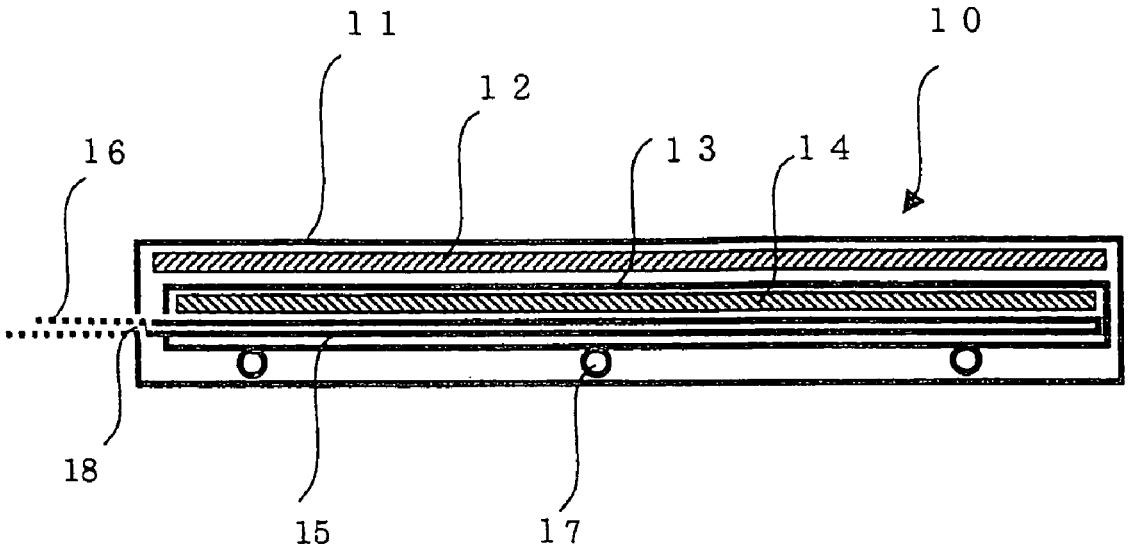
FIG. 1 is a longitudinal sectional view of a tape heater made in an example of the present invention.

A tape heater of the present invention includes a substrate strip, an electric heating wire, acting as a heating element, on the substrate strip. The substrate strip and the electric heating wire are wrapped with a wrap comprising a heat-resistant resin sheet.

The electric heating wire is not particularly limited, but may be a nichrome wire. The power consumption of the nichrome wire is selected according to the use of the tape heater, but normally measures 10 to 500 W. The periphery of the nichrome wire is preferably covered with a heat-resistant, electrically insulative protective layer from the viewpoint of safety and durability. The protective layer is not particularly limited, but may be a silica sleeve, a cloth sleeve, an alumina sleeve, a glass sleeve, or cloth. Among these the silica sleeve is preferable from the viewpoint of safety. The heating element may be in a plate form. Any type of heating element may be used as long as generating heat by resistance heating.

The substrate strip, which supports the electric heating wire, is heat-resistant and flexible, and preferably thermally insulative. Exemplary material of the substrate strip include fluorocarbon resins, such as PTFE, PFT, FEP, PCTFE, ETFE, ECTFE, and PVdF; heat-resistant organic materials, such as aramid resin, polyamide, polyimide, polycarbonate, polyacetal, polybutylene terephthalate, modified polyphenylene ether, polyphenylene sulfide, polysulfone, polyethersulfone, polyarylate, and poly(ether-ether-ketone); and inorganic textile fabric or nonwoven fabric, such as those of glass, ceramics, and silica. These are appropriately selected according to heating temperature. These materials may be used in singly or in combination. The substrate strip may be in sheet form as long as it is flexible.

The substrate strip is not particularly limited in size, but may have a thickness in the range of 0.5 to 3 mm, a width in the range of 10 to 50 mm, and a length in the range of 500 to 1000 mm. The thickness and the area may be increased or reduced as required. Two substrate strips may be layered.

The manner how the electric heating wire is disposed is not particularly limited. The electric heating wire may be bound to the substrate strip with a heat-resistant thread, yarn, or wire, such as a glass yarn, a silica yarn, or an alumina yarn. These may be coated with a fluorocarbon resin. Alternatively, the heating wire may be bonded onto the substrate strip with a mesh sheet pressing the wire, or the heating wire may be fixed by sewing with a sewing machine. Preferably, the electric heating wire is not covered with a heat-insulating material, form the viewpoint of heat efficiency.

The wrap is principally intended to prevent dust from flying off, the dust which is slightly caused by bends of the electric heating wire or the substrate strip. The heat-resistant sheet serving as the wrap is flexible, and from which dust desirably does not occur due to bending or friction. Preferably, it is formed of a fluorocarbon resin, and more preferably PTFE, from which dust substantially does not occur.

The electric heating wire and the substrate strip are wrapped with the heat-resistant wrap, and the wrap is subjected to heat adhesion if possible. If the wrap is not capable of heat adhesion, a heat-adhesive resin layer may be provided in regions to be bonded for wrapping. For such heat adhesion, a heat sealer or a heat press may be used.

In wrapping, a lead-out port is provided for supplying electricity to the electric heating wire, and power lines are connected to the ends of the heating wire and drawn out of the lead-out port. The lead-out port is normally provided at the midsection of an end in the longitudinal direction of the wrapped structure, but it is not particularly limited to this. The port may be provided in two or more positions, if necessary. The port may have any known structure as long as it has a strength sufficient not to be broken.

For the electric heating wire, it suffices to draw the ends of the-power lines connected to the electric heating wire out of the lead-out port. The ends of the power lines may be in a male plug form capable of being easily connected to a power supply, such as a wall outlet or a table tap, or in a female plug form. If there are two lead-out ports, the end of one power line has a male plug and the end of the other power line has female plug so that at least two tape heater can be connected in series.

Preferably, the lead-out port fixes the power lines. More preferably, it is sealed to prevent air circulation as well as to fix the power lines. When it is sealed, the inside of the wrap may be evacuated as much as possible. This can prevent convection in the internal space of the wrap to enhance the heat insulation efficiency. For sealing the lead-out port, the upper side and lower side of the wrap may be subjected to heat adhesion or the like, or the spaces between the upper and lower sides of the wrap and the power lines may be filled with a curable sealant that is subsequently cured. Such sealants include PFA, silicon rubber, epoxy resin, and urethane resin. Among these sealants PFA is preferably used. The inventers of the present invention have found that use of such a sealant prevents dust from occurring after curing.

Preferably, the surface (heating surface) having the electric heating wire of the substrate strip is covered with a heat-conductive material (heat-uniformization sheet). By covering the heating surface with the heat-conductive sheet, heat generated by the heating wire can be uniformly distributed at the heating surface side and, thus, the resulting tape heater can uniformly heat pipes or other objects to be heated. If the rear surface of the substrate strip (non-heating surface) is also covered with the heat-conductive material, a heat-insulating layer is preferably provided in a manner described later.

Exemplary heat-conductive sheets include metal foils, and particularly aluminium foil is preferable in practice. The heat-conductive sheet may be composed of a single-layer metal foil or at least two layers of metal foils. The metal foil may be reinforced to prevent breakage by layering a heat-resistant film or the like if necessary. In this instance, preferably, the heat-resistant film has a thickness as small as possible. Even if the heat-conductive sheet is electrically conductive, short-circuiting is prevented because the electric heating wire is covered with a heat-resistant, electrically insulative material or other protective layers.

At least one thermocouple for sensing temperature may be provided between the heat-resistant resin wrap and the heat-conductive sheet. In this instance, the lead wires of the thermocouple are drawn out of the above-described lead-out port when the wrap is provided or the lead-out port is sealed. Preferably, the ends of the lead wires are provided with connecters capable of being connected to a thermo-controller.

At least one bimetal switch may be provided between the heat-resistant resin wrap and the heat-conductive sheet. In this instance, the bimetal switch is set so as to switch at a predetermined temperature to control.

A thermal fuse of, for example, 150° C. in maximum temperature may be provided in series with the electric heating wire from the viewpoint of safety and prevention of overheating.

The tape heater may further include a heat-insulating layer between the warp and the surface (non-heating surface) opposite the heating surface of the substrate strip. The heat-insulating layer preferably comprises a heat-resistant, flexible material. Exemplary material of the heat-insulating layer include fluorocarbon resins, such as PTFE, PFT, FEP, PCTFE, ETFE, ECTFE, and PVdF; heat-resistant organic materials, such as aramid resin, polyamide, polyimide, polycarbonate, polyacetal, polybutylene terephthalate, modified polyphenylene ether, polyphenylene sulfide, polysulfone, polyethersulfone, polyarylate, and poly(ether-ether-ketone); and inorganic textile fabric or nonwoven fabric, such as those of glass, ceramics, and silica. These are appropriately selected according to heating temperature. These materials may be used in singly or in combination. The heat-insulating layer may be in sheet form as long as it is flexible. Two or more of relatively thin heat-insulating layers may be laid one on top of another. In this instance, preferably, the layers are partly bonded with one another.

The present invention will now be further described using an example in detail. However, the example is not limit the present invention.

EXAMPLE

An example will be described with reference to FIG. 1.

A glass fiber tape was prepared for a substrate strip 14 which was formed of a nonwoven fabric made of glass fibers with a mean diameter of 3 μm, having a thickness of 1.5 mm, a width of 32 mm, and a length of 1050 mm. A 100-watt nichrome wire (NCH-2, manufactured by Nippon Metal Industry Co., Ltd.) covered with a silica sleeve was disposed as the electric heating wire 15, along the longitudinal direction of the substrate strip 14 with four U-turns, and was bound to the strip with a glass yarn at intervals of 5 cm in the longitudinal direction of the substrate strip 14. The ends of the nichrome wire 15 were connected to power lines 16 covered with an insulating coating, having male plugs.

The substrate strip 14 including the nichrome wire 15 was wrapped with two layers of aluminium foil serving as a heat-uniformization sheet (heat-conductive material) 13, each having a thickness of 50 μm, in such a manner that only the power lines 16 were exposed. Three type-K thermocouples 17 of 0.32 mm in diameter were disposed at both ends and midsection in the longitudinal direction of the heat-uniformization sheet 13, on the surface of the heat-conductive sheet at the side of the heating surface, on which the nichrome wire 15 was disposed. Two layers of the glass fiber tapes, which is the same material as the substrate 14, were disposed as the heat-insulating layer 12 on the surface (non-heating side) of the heat-conductive sheet opposite the surface having the thermocouples.

The resulting structure was disposed between the layers of a PTFE wrap 11 of 0.1 mm in thickness by 90 mm in width by 1100 mm in length, folded in half to a width of 45 mm. The lead wires (not shown in the figure) of the thermocouples 17, which are insulated with a fluorocarbon resin tube, are aligned with the position (lead-out port 18) where the power lines 16 were exposed. The open sides of the PTFE wrap 11 were covered with a PFA sheet with a width of 5 mm and thermo-compressed to seal at 360° C. using a heat sealer. Thus, a tape heater of the present invention having the power lines and the lead wires (not shown in the figure) drawn out of the lead-out port 18 was completed.

The tape heater was wound around a bend of a pipe of 25.4 mm in diameter and 100 cm in length, curved at right angle with a curvature radius of 10 cm. The lead wires of the three thermocouples were connected to respective thermo-controllers (not shown in the figure) and the temperature was set at 150° C. The power lines were plugged into the control power source of the thermo-controller to heat the curved pipe. As a result, the tape heater sufficiently heated the pipe with a close contact with the bend of the pipe without forming a gap.

What is claimed is:

1. A tape heater comprising:

a heat-resistant, flexible substrate strip having two surfaces, and comprising inorganic textile fabric or nonwoven fabric;

a heating element disposed on a first surface of the substrate strip by being bound or sewn with a sewing machine to said first surface of the substrate strip with a heat resistant thread, yarn or wire, the first surface being defined as a heating surface; and a wrap comprising a heat-resistant resin sheet, wrapping the substrate strip and the heating element, wherein the heating element is a heating wire whose periphery is covered with a heat-resistant, insulative layer.

2. A tape heater according to claim 1, further comprising a heat-conductive material between the heating element and the wrap.

3. A tape heater according to claim 1, further comprising a heat-insulating layer between the wrap and the second surface of the substrate strip.

4. A tape heater according to claim 1, wherein the wrap comprises a fluorocarbon resin film or polytetrafluoroethylene (PTFE) sheet.

5. A tape heater according to claim 1, wherein the inside of the wrap is evacuated.

6. A pipe-heating structure comprising:

a tape heater comprising a heat-resistant, flexible substrate strip comprising inorganic textile fabric or nonwoven fabric;

a heating element disposed on a surface of the substrate strip by being bound or sewn with a sewing machine to the surface of the substrate strip with a heat resistant thread, yarn or wire; and a wrap comprising a heat-resistant resin sheet, wrapping the substrate strip and the heating element; and a pipe wound with the tape heater in a spiral manner.

7. A method for applying a pipe-heating structure, comprising:

the step of winding a tape heater around a pipe in a spiral manner, wherein the tape heater comprises:

a heat-resistant, flexible substrate strip comprising inorganic textile fabric or nonwoven fabric;

a heating element disposed on a surface of the substrate strip by being bound or sewn with a sewing machine to the surface of the substrate strip with a heat resistant thread, yarn or wire; and a wrap comprising a heat-resistant resin sheet, wrapping the substrate strip and the heating element.

* * * * *